US011250711B1

(12) United States Patent
Teague et al.

(10) Patent No.: US 11,250,711 B1
(45) Date of Patent: Feb. 15, 2022

(54) MANEUVER EVALUATION AND ROUTE GUIDANCE THROUGH ENVIRONMENT

(71) Applicant: Rockwell Collins, Inc., Cedar Rapids, IA (US)

(72) Inventors: Jacob Teague, West Melbourne, FL (US); Venkata Sishtla, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/984,994

(22) Filed: Aug. 4, 2020

(51) Int. Cl.
*G08G 5/00* (2006.01)
*G08G 5/04* (2006.01)

(52) U.S. Cl.
CPC ..... *G08G 5/0039* (2013.01); *G08G 5/0004* (2013.01); *G08G 5/0021* (2013.01); *G08G 5/0052* (2013.01); *G08G 5/045* (2013.01)

(58) Field of Classification Search
CPC .... G08G 5/0039; G08G 5/0052; G08G 5/045; G08G 5/0021; G08G 5/0004
See application file for complete search history.

(56) References Cited

U.S. PATENT DOCUMENTS 6,289,277 B1 * 9/2001 Feyereisen ..... G01C 21/005 701/528
6,828,922 B1 12/2004 Gremmert et al.
7,194,353 B1 3/2007 Baldwin et al.
8,234,068 B1 7/2012 Young et al.
8,718,915 B1 * 5/2014 Turcios ..... G08G 5/0086 701/448
8,843,303 B1 9/2014 Young et al.
9,524,571 B2 12/2016 Coulmeau et al.
9,754,496 B2 9/2017 Chan et al.
9,824,593 B1 11/2017 Kronfeld et al.
9,870,712 B1 1/2018 Weichbrod
10,089,890 B2 10/2018 Ubhi et al.
10,163,357 B2 12/2018 Venkatraman et al.
10,540,900 B2 1/2020 Butler et al.
10,657,828 B2 5/2020 Sawhill et al.
2003/0195672 A1 * 10/2003 He ..... G08G 5/0052 701/3
2004/0044445 A1 * 3/2004 Burdon ..... G01C 23/00 701/3
2016/0041305 A1 * 2/2016 Stulken ..... G06Q 10/047 340/977
2016/0140851 A1 5/2016 Levy et al.
2016/0236790 A1 * 8/2016 Knapp ..... B64C 11/001
2018/0061251 A1 * 3/2018 Venkatraman ..... B64C 39/02
2018/0366008 A1 12/2018 Dacre-Wright et al.
2019/0043368 A1 2/2019 Priest
(Continued)

FOREIGN PATENT DOCUMENTS

EP 3469435 A1 4/2019

*Primary Examiner* — Andrew W Bee
(74) *Attorney, Agent, or Firm* — Suiter Swantz pc llo

(57) ABSTRACT

A system and method for correlating hazard data includes defining flight corridors according to hazard thresholds based on criticality weightings derived from multiple sources, and incorporating multiple hazard types. The flight corridors are render in a visually distinct way according to the corresponding hazard threshold. An autonomous aircraft determines an executable flight path within a flight corridor having a maximum allowable hazard threshold.

15 Claims, 3 Drawing Sheets

(56) References Cited

U.S. PATENT DOCUMENTS

| | | | | |
|---|---|---|---|---|
| 2019/0172358 | A1* | 6/2019 | Zhou | G08G 5/006 |
| 2019/0205609 | A1* | 7/2019 | Taveira | G05D 1/0202 |
| 2019/0259287 | A1 | 8/2019 | Mustafic et al. | |
| 2019/0371183 | A1* | 12/2019 | Mecklem | G08G 5/0078 |
| 2020/0074868 | A1 | 3/2020 | Postrel | |
| 2020/0105149 | A1 | 4/2020 | Mahkonen et al. | |
| 2020/0118447 | A1* | 4/2020 | Gowda | G08G 5/0091 |
| 2020/0258400 | A1* | 8/2020 | Yuan | G05D 1/106 |
| 2020/0286388 | A1* | 9/2020 | Velastri | G08G 5/0034 |
| 2020/0286391 | A1* | 9/2020 | Beaurepaire | G08G 5/045 |

* cited by examiner

MANEUVER EVALUATION AND ROUTE GUIDANCE THROUGH ENVIRONMENT

BACKGROUND

In complex weather scenarios, the decision for avoidance or penetration is based on the crew's interpretation of displayed data and their experience in the environment. Extensive crew experience is not available during autonomous flight and adds to pilot workload in single pilot operations. Existing display systems add features and overlays to provide more information but additional features and overlays clutter the display and may obscure vital information. Furthermore, separate systems may need to be consulted to account for non-weather hazards, further increasing pilot workload.

SUMMARY

In one aspect, embodiments of the inventive concepts disclosed herein are directed to a system and method for correlating hazard data and defining flight corridors according to hazard thresholds based on criticality weightings derived from multiple sources, and incorporating multiple hazard types. The flight corridors are render in a visually distinct way according to the corresponding hazard threshold.

In a further aspect, an autonomous aircraft determines an executable flight path within a flight corridor having a maximum allowable hazard threshold.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
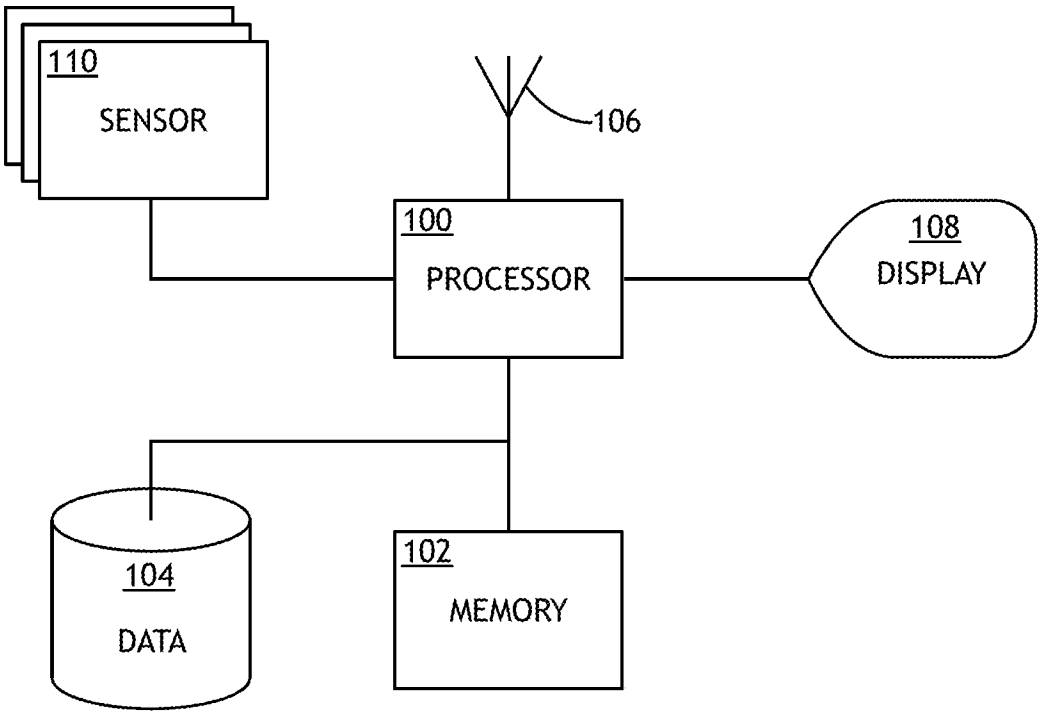
FIG. 1 shows a block diagram of a system suitable for executing an exemplary embodiment.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system and method for correlating hazard data and defining flight corridors according to hazard thresholds based on criticality weightings derived from multiple sources, and incorporating multiple hazard types. The flight corridors are render in a visually distinct way according to the corresponding hazard threshold.

Referring to FIG. 1, a block diagram of a system suitable for executing an exemplary embodiment is shown. The system includes at least one processor 100 and a memory 102 for embodying processor executable code. The processor 100 is configured to receive a plurality of data points from a plurality of sources, each pertaining to in-flight hazards. The processor 100 may receive data from a data storage element 104, one or more data communication devices 106, and/or one or more of a plurality of on-board sensors 110. Data points pertaining to in-flight hazards may include, but are not limited to, data associated with proximal aircraft traffic such as a current location and trajectory of nearby aircraft that may pose a collision risk, data associated with terrain features, and data associated with the location and nature of weather events such as size, severity, and direction. Weather events may include, but are not limited to, turbulence, icing, lighting, hail, etc.

In at least one embodiment, the processor 100 collates the data points based on their real-world locations. The processor 100 assigns a weighting to each data point based on the criticality of the data point. Criticality may be generally associated with a level of risk associated with the data point; for example, a nearby terrain feature may indicate a high criticality near the terrain feature but a rapidly diminishing criticality with distance. Likewise, weather events my indicate moderate criticality, diminishing more slowly with distance or generally covering a larger area. Furthermore, an aircraft collision risk a high criticality along the aircraft's current trajectory with moderate and/or increasing criticality with distance representing the potentiality of the aircraft to change course.

In at least one embodiment, the processor 100 receives one or more flight path checkpoints. The processor 100 identifies one or more flight corridors along the flight path, each corridor defined threshold hazard values. For example, a first corridor may be defined by a specified distance from a flight path where the hazard value never exceeds a "safe" threshold, a second corridor may be defined by the flight path and any portion along the flight path with a criticality value that exceeds the "safe" threshold but does not exceed an "avoid" threshold, and a third corridor may be defined by the flight path and any portion along the flight path with a criticality value that exceeds the "avoid" threshold.

In at least one embodiment, the processor 100 may utilize the weighted data points to define a local field of hazard values via interpolation. Such field would comprise a consolidated hazard map of a local region without distinguishing the nature of any hazards for rendering purposes. A rendered hazard map, including rendered flight path corridors, may be rendered on a display device 108. Alternatively, or in addition, an autonomous aircraft may utilize the hazard map to make avoidance or penetration decisions autonomously.

In at least one embodiment, the processor 100 utilizes algorithms configured to apply weights to hazard data based on the nature of the data (weather, terrain, traffic, etc.), unpredictability of the data (weather events and aircraft traffic being mobile as compared to terrain), severity of the hazard, and metrics of the corresponding aircraft (for example, certain weather events may be less hazardous to large aircraft than to smaller aircraft, while terrain features may be uniformly hazardous). Alternatively, or in addition, the processor 100 may implement a neural network trained to assign hazard values based on a data set of sensor inputs and identified hazard values.

Figure 2:
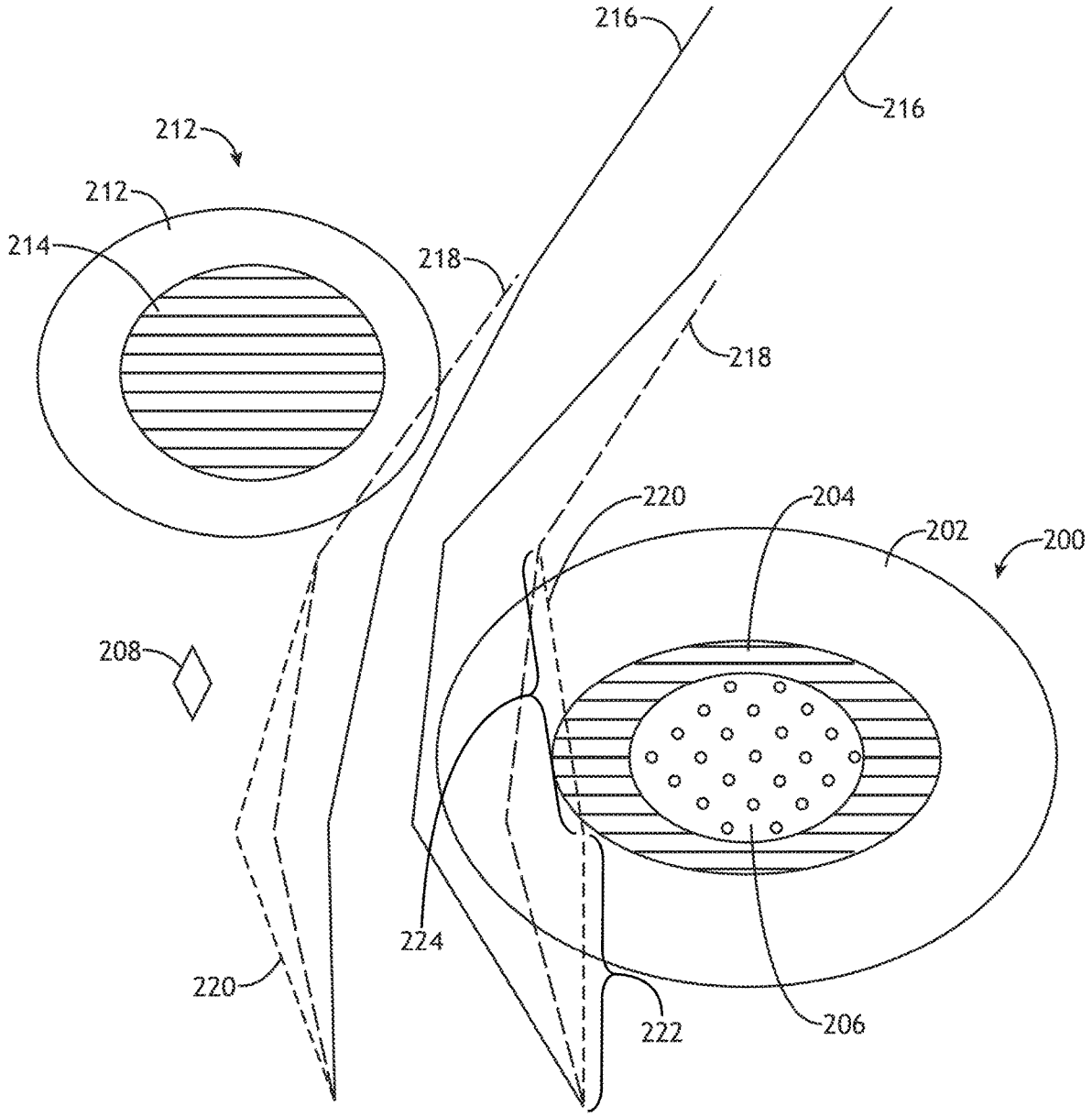
FIG. 2 shows a block diagram of rendered, consolidated hazard data according to an exemplary embodiment.

Referring to FIG. 2, a block diagram of rendered, consolidated hazard data according to an exemplary embodiment is shown. Where a system utilizes independent hazard data to create a consolidated representation of hazard values, various hazardous regions 200, 208, 210 may be represented in a unified manner, and rendered according to artifices corresponding to threshold hazard values. For example, a first region 200 may define a "safe" area 202 rendered in green, a "caution" area 204 rendered in yellow, and an "avoid" area 206 rendered in red. Likewise, a second region 210 may define a "safe" area 212 and a "caution" area 214. The first region 200 and second region 210 may not necessarily be associated with or defined by any specific hazardous event, but rather are the cumulative result of hazards in or near the region 200, 210. Furthermore, specific aircraft traffic 208 may be rendered as a specific moving traffic element 208, a hazard region defined by the aircraft traffic and the corresponding trajectory, or both.

In at least one embodiment, one or more flight corridors 216, 218, 220 may be rendered according to a threshold hazard level, utilizing an artifice to visually indicate the hazard level. For example, a "safe" flight corridor 216 defined by one or more flight path checkpoints may be rendered in green. Portions of a potential flight path that include legs 218 passing through or near a "caution" area 204, 214 may be rendered in yellow. Portions of a potential flight path that include legs 220 passing through or near an "avoid" area 206, including local aircraft traffic, may be rendered in red. In at least one embodiment, diverging corridors 222 may represent increasingly hazardous paths while converging corridors 224 may represent diminishing hazardous paths.

In at least one embodiment, hazard threshold values may be aircraft specific. Alternatively, hazard threshold values may be predefined while on-board aircraft computers may interpret the aircraft's capacity to transit hazardous conditions as represented by the hazard values.

In at least one embodiment, the corridors 216, 218, 220 start at the sides of the aircraft and extend towards the destination. Flight crew may choose to render just the corridors 216, 218, 220 which may eliminate the need to display actual weather; thereby minimizing pilot workload.

Figure 3:
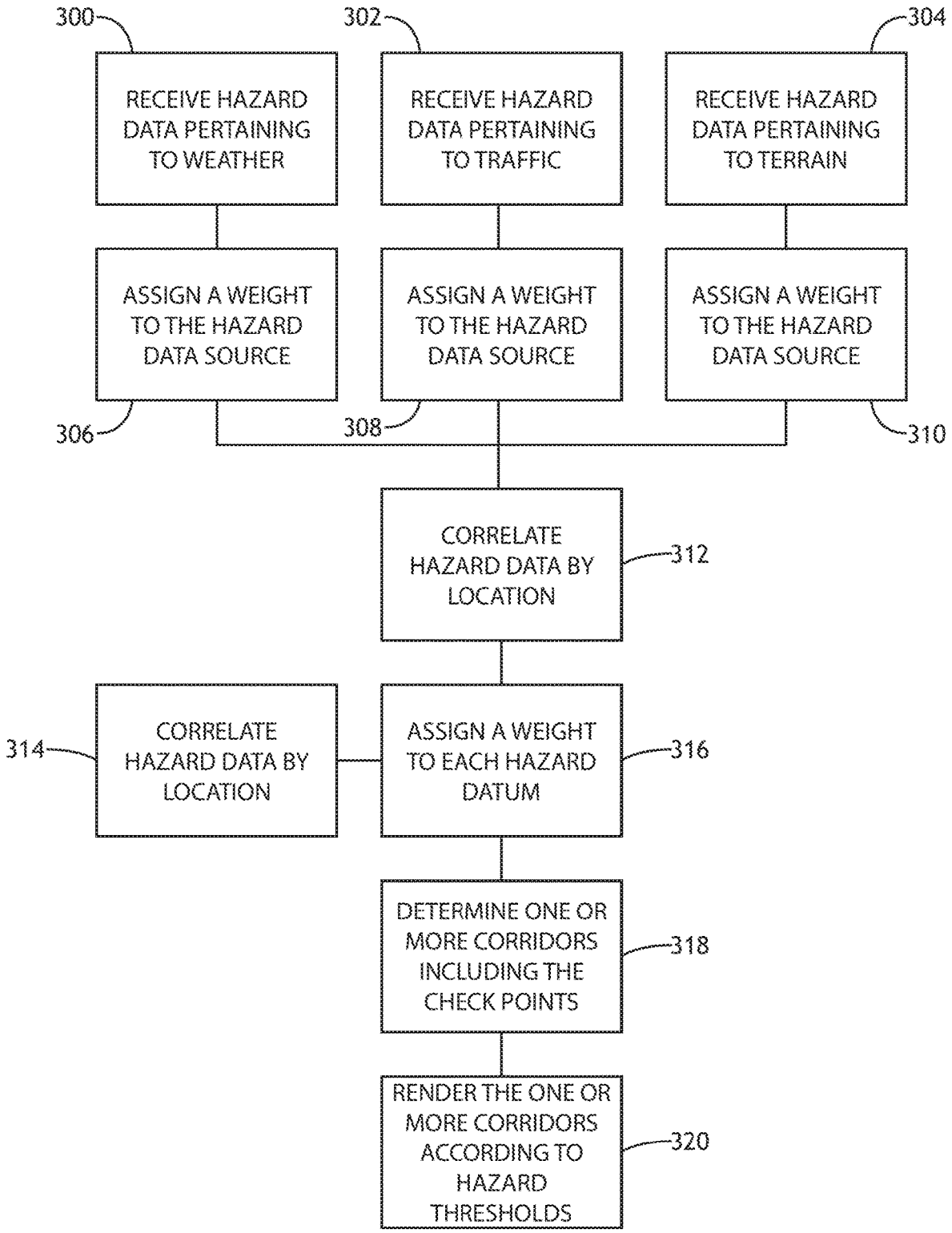
FIG. 3 shows a flowchart of a method for consolidating hazard data according to an exemplary embodiment.

Referring to FIG. 3, a flowchart of a method for consolidating hazard data according to an exemplary embodiment is shown. A system implementing the method receives 300, 302, 304 hazard data pertaining to any number of events, including weather, local aircraft traffic, and local terrain. In at least one embodiment, each data point may be assigned 306, 308, 310 an initial weigh based on the source of the data point; for example, known reliable sources may be weighted higher than potentially unreliable sources.

Each data point is correlated 312 according to a location of the data point; for example, weather data at a specific location and terrain data for the same specific location are associated such that hazard values at that specific location may be combined. Each data point is assigned 316 a weight, algorithmically or via a machine learning system, based on the severity of the hazard represented by the data point. For example, another aircraft may represent a higher threat than a thunderstorm. All weights at each location are combined to determine a consolidated hazard value at that location.

In at least one embodiment, the system receives 314 one or more checkpoints defining a flight path. The system determines 318 one or more corridors along the flight path defined by the check points. The corridors are defined by hazard values and hazard threshold value for the specific aircraft. The corridors are rendered 320 with visually distinguishable artifacts, such as color coding. In at least one embodiment, the consolidated hazard values define a hazard map that may also be rendered with visually distinguishable artifacts.

Systems and methods according to exemplary embodiments help autonomous aircraft by providing absolute guidance to maneuver around threats such as weather and traffic. For single pilot operation, a comprehensive threat snapshot helps reduce pilot workload. This guidance can be used for current aircraft without the need for upgrading existing displays. This method simplifies flight planning and weather avoidance while decreasing operational costs, increasing operational efficiency and improving safety.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A computer apparatus comprising:

a data communication device;

a display device;

a data storage element; and at least one processor in data communication with the data communication device, the display device, the data storage element, and a memory storing processor executable code for configuring the at least one processor to:

receive hazard data from a plurality of sources via the data communication device;

assign a criticality weight to each hazard datum defined by at least a level of risk associated with the corresponding hazard datum;

correlate each hazard datum according to a location associated with each hazard datum;

define one or more flight corridors, each corresponding to a hazard threshold defined by the weight correlated hazard data; and render the one or more flight corridors, each with a visually distinct artifice.

2. The computer apparatus of claim 1, wherein:

the at least one processor is further configured to receive one or more flight path checkpoints; and the criticality weight is further defined by a distance from a flight path defined by the one or more flight path checkpoints.

3. The computer apparatus of claim 1, wherein:

the at least one processor is further configured to receive one or more performance metrics corresponding to capabilities of an aircraft; and the criticality weight is further defined by the one or more performance metrics.

4. The computer apparatus of claim 1, wherein at least one of the hazard data corresponds to proximal aircraft traffic.

5. The computer apparatus of claim 4, wherein the criticality weight is at least partially defined by a collision probability based on a current trajectory of the proximal aircraft traffic.

6. The computer apparatus of claim 1, wherein the hazard data correspond to classes including locations and trajectories of proximal aircraft traffic, locations and trajectories of proximal weather events, and locations of terrain features.

7. The computer apparatus of claim 6, wherein the criticality weight of each hazard datum is at least partially defined by the class of the corresponding hazard datum.

8. A method comprising:

receiving hazard data from a plurality of sources;

assigning a criticality weight to each hazard datum defined by at least a level of risk associated with the corresponding hazard datum;

correlating each hazard datum according to a location associated with each hazard datum;

defining one or more flight corridors, each corresponding to a hazard threshold defined by the weight correlated hazard data; and rendering the one or more flight corridors, each with a visually distinct artifice.

9. The method of claim 8, further comprising establishing a local field of hazard values based on the weight correlated hazard data by interpolating interstitial hazard values.

10. The method of claim 8, further comprising receiving one or more performance metrics corresponding to capabilities of an aircraft, wherein the criticality weight is further defined by the one or more performance metrics.

11. The method of claim 8, wherein at least one of the hazard data corresponds to proximal aircraft traffic.

12. The method of claim 11, wherein the criticality weight of the at least one of the hazard data is at least partially defined by a probability of collision given a current trajectory of the proximal aircraft traffic.

13. The method of claim 8, wherein the hazard data correspond to classes including locations and trajectories of proximal aircraft traffic, locations and trajectories of proximal weather events, and locations of terrain features.

14. The method of claim 13, wherein the criticality weight of each hazard datum is at least partially defined by the class of the corresponding hazard datum.

15. The method of claim 8, further comprising identifying an executable flight path within one of the flight corridors within a maximum hazard threshold.

* * * * *